US005413231A

United States Patent [19]

Carroll et al.

[11] Patent Number: 5,413,231

[45] Date of Patent: May 9, 1995

[54] BOTTLE HANDLE

[76] Inventors: David W. Carroll, 1306 Mayflower Dr., Northfield, Minn. 55057; Wendell L. Carroll, 4134 40th Ave. S., Minneapolis, Minn. 55406; Jimmy W. Davidson, 6660 Upper Afton Rd., Woodbury, Minn. 55125

[21] Appl. No.: 48,727

[22] Filed: Apr. 15, 1993

[51] Int. Cl.[6] ..... B65D 23/10

[52] U.S. Cl. ..... 215/396; 220/741; 220/759

[58] Field of Search ..... 215/100 A, 100 C; 220/758, 759, 741

[56] References Cited

U.S. PATENT DOCUMENTS

| | | | |
|---|---|---|---|
| D. 149,933 | 6/1948 | Bushman . | |
| 2,774,510 | 12/1956 | Logan | 220/759 X |
| 2,801,743 | 8/1957 | Green | 215/100 A X |
| 3,202,309 | 8/1965 | Simpson | 215/100 A |
| 4,273,246 | 6/1981 | Thompson | 215/100 A |
| 4,602,723 | 7/1986 | DeMars | 220/759 X |
| 4,654,274 | 3/1987 | DeMars | 215/100 A X |
| 4,896,913 | 1/1990 | Kennedy . | |
| 4,936,614 | 6/1990 | Russell | 215/100 A X |
| 4,993,675 | 2/1991 | Walker | 220/759 X |
| 5,013,074 | 5/1991 | Galle | 215/100 A X |
| 5,025,940 | 6/1991 | Akly . | |
| 5,054,638 | 10/1991 | Rose | 220/759 |
| 5,176,280 | 1/1993 | Robbins, III | 215/100 A X |
| 5,183,169 | 2/1993 | Grzych | 220/741 X |

FOREIGN PATENT DOCUMENTS

| | | | |
|---|---|---|---|
| 2076564 | 2/1993 | Canada | 220/741 |

*Primary Examiner*—Allan N. Shoap
*Assistant Examiner*—Christopher J. McDonald
*Attorney, Agent, or Firm*—Patterson & Keough

[57] ABSTRACT

A bottle handle specially adapted to lift large beverage bottles including a spout, a body and a base. The bottle handle includes a spout attachment mechanism, a base engagement mechanism and a handle operably coupled to the spout attachment mechanism and base engagement mechanism. In operation, when the handle is lifted, the action biases the spout attachment means against the bottle spout and the base engagement means against the bottle base to support and lift the bottle.

12 Claims, 5 Drawing Sheets

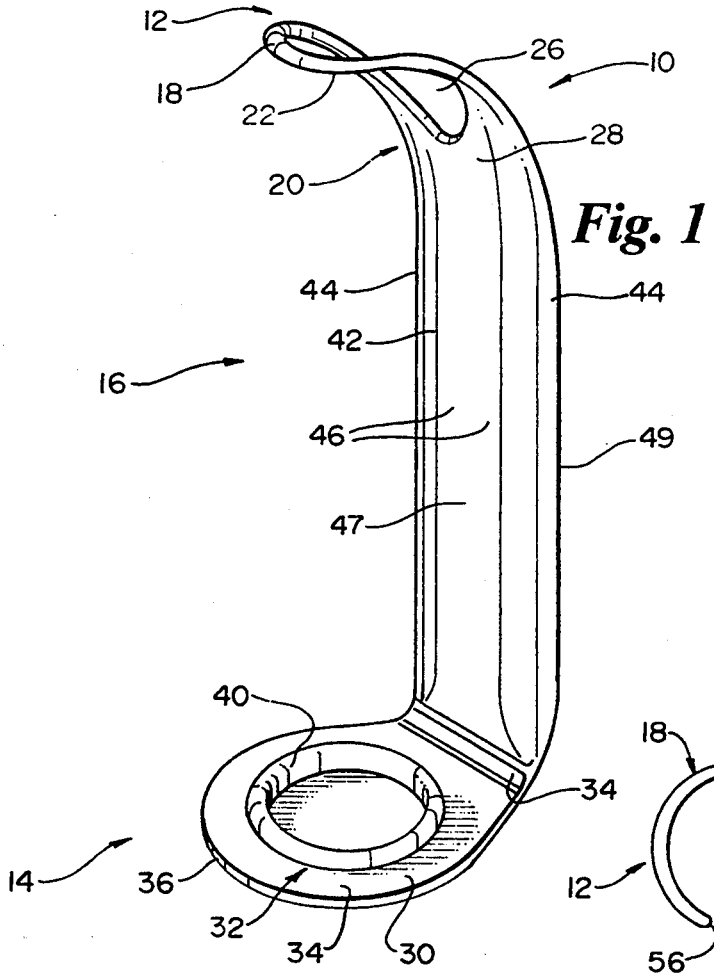
Fig. 1
Fig. 16
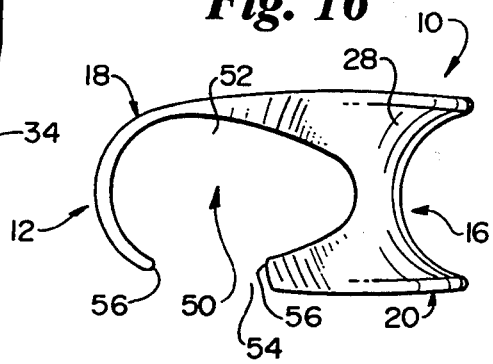
Fig. 2
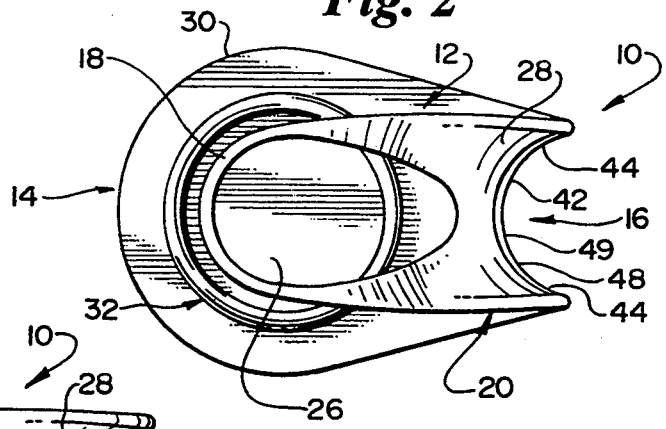
Fig. 17
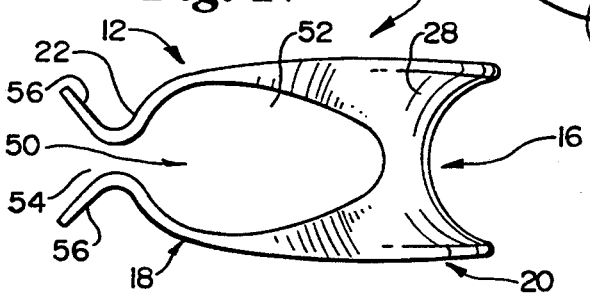

BOTTLE HANDLE

TECHNICAL FIELD

The present invention deals broadly with the field of container handles. More specifically, the present invention relates to a detachable bottle handle coupled to and supporting a bottle at the bottle spout and base.

BACKGROUND OF THE INVENTION

Conventional liquid containers such as bottles include a generally cylindrical body and structure defining a narrow tubular spout. The narrow spout of the bottle minimizes spillage and the body holds a majority of the liquid stored within the bottle. With the advent of plastics, larger bottles, such as those holding up to two liters of liquid, are common today.

However, these large bottles require two hands to lift and pour. The generally smooth surface of the bottle body makes a larger bottle difficult to grasp. As the liquid is poured out of the bottle, the plastic bottle frequently starts to collapse. The changing size and shape of the bottle as it collapses makes the bottle increasingly difficult to grasp firmly. Children, especially, because of their small hands, find the large soda pop bottles difficult to manipulate. In addition, condensation on the bottle increases the risk of dropping and breaking the bottle or spilling the bottle contents.

A solution to the problem of lifting large beverage bottles and pouring their contents is to attach a handle to the bottle. Traditional bottle handles are attached to a container encircling the bottle body, such as, for example, the straw holders often seen surrounding large wine bottles. These traditional handles support the bottle body and rely on brute force to lift the bottle. In addition, the utility of the traditional handles is limited by the particular size and shape of the bottles to which the container is tailored.

A bottle handle easily attached to large beverage bottles and graspable by one hand or by a child's hands that reduces the effort required to lift any bottle would be greatly appreciated.

SUMMARY OF THE INVENTION

The present invention is a bottle handle specially adapted to lift large beverage bottles including a spout, a body and a base. The bottle handle includes a spout attachment mechanism, a base engagement mechanism and a handle operably coupled to the spout attachment mechanism and base engagement mechanism. In operation, when the handle is lifted, the action biases the spout attachment means against the bottle spout and the base engagement means against the bottle base to support and lift the bottle.

BRIEF DESCRIPTION OF THE DRAWINGS

FIG. 1 is a perspective view of a bottle handle in accordance with the present invention;

FIG. 2 is a top plan view of the bottle handle of FIG. 1;

FIG. 16 is a fragmentary top plan view of a bottle handle showing a first alternate embodiment of the spout attachment mechanism;

FIG. 17 is a fragmentary top plan view of a bottle handle showing a second alternate embodiment of the spout attachment mechanism;

DETAILED DESCRIPTION OF THE INVENTION

Figure 3:
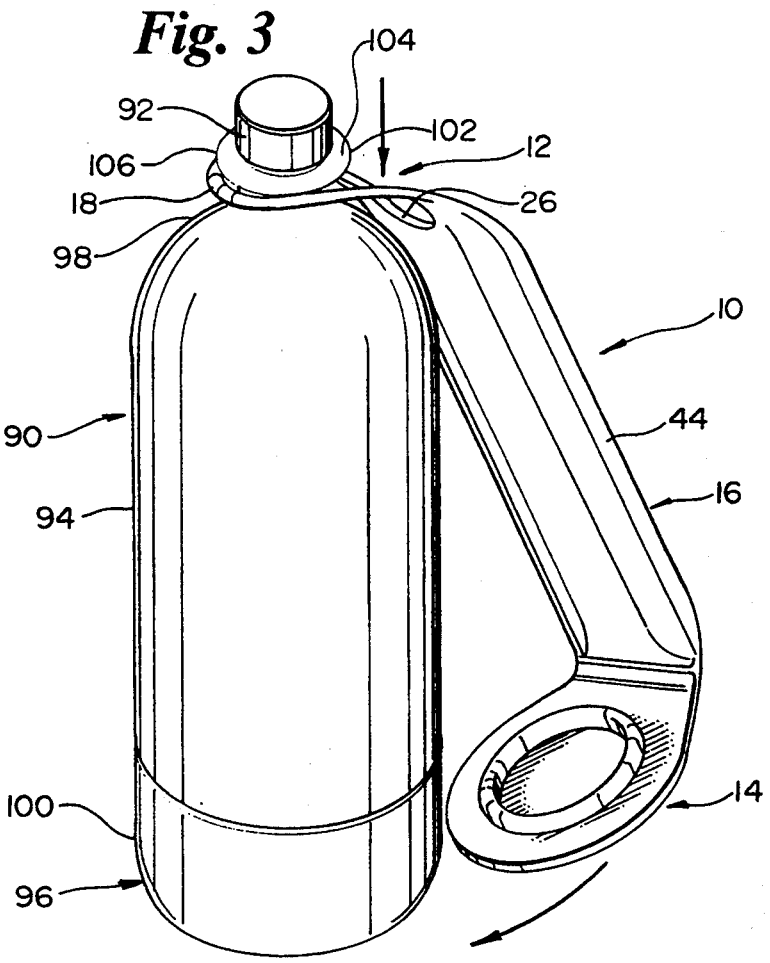
FIG. 3 is a perspective view of a bottle handle showing a handle partially installed on the bottle.

Referring to the drawings, FIG. 1 illustrates a bottle handle 10 in accordance with this invention. The bottle handle 10 broadly includes a spout attachment mechanism 12, base engagement mechanism 14 and handle 16.

Referring to FIG. 1, in the preferred embodiment, the spout attachment mechanism 12 includes a spout collar 18 and collar base 20. The spout collar 18 extends generally horizontally and presents an outer collar margin 22.

The spout collar 18 includes structure defining a generally circular or ovoid collar opening 26. It will be understood that the shape of the collar opening 26 could also be a multi-sided polygon. The collar base 20 is an arcuate plate 28 extending downwardly from the spout collar 18 to the handle 16. The spout attachment mechanism 12 is formed of a somewhat flexible self-biasing material.

In the preferred embodiment, the base engagement mechanism 14 includes a generally circular base plate 30 and securing member 32. The base plate 30 carries an inner surface 34 and outer plate edge 36 and includes an arcuate biasing heel 34 extending outward and upward from the base plate 30 to the handle 16. The biasing heel 34 is formed of a somewhat flexible self-biasing material. In the preferred embodiment, the securing member 32 is a generally circular annular projection 40 joined to the inner surface 34 in a position generally a uniform distance from the outer plate edge 36 and projecting upward from the inner surface 34. The projection 40 is generally aligned vertically with spout collar 18 as shown in FIG. 2.

The handle 16 is operably coupled to the spout attachment mechanism 12 and base engagement mechanism 14 and extends generally vertically upward from the base engagement mechanism 14 to the spout attachment mechanism 12. In the preferred embodiment, the handle 16 includes a generally planar spine 42 and opposed finger grips 44 extending outwardly from the spine 42. The spine 42 carries opposed side margins 46, an inner face 47 and an outer face 49. Each finger grip 44 is joined to the spine 42 along at least a portion of one of the side margins 46. In the preferred embodiment, the outer face 49 of the spine 42 and finger grips 44 define an arcuate handle channel 48 as shown in FIG. 2.

For clarity in description, the alternate embodiments of this invention are grouped according to their name as described in the preferred embodiment. For example, the alternate embodiments of the spout attachment mechanism will be discussed together, then the alternate embodiments of the base engagement mechanism 14 and then the alternate embodiments of the handle 16.

Figure 19:
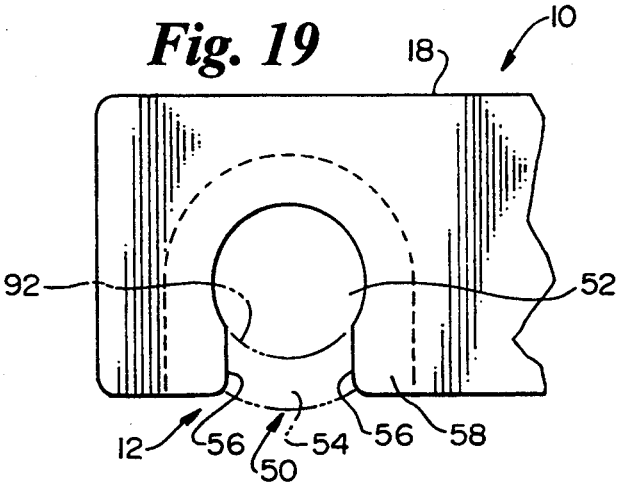
FIG. 19 is a fragmentary top plan view of a bottle handle showing a fourth alternate embodiment of the spout attachment mechanism with a fifth alternate embodiment shown in dashed phantom lines.
Figure 20:
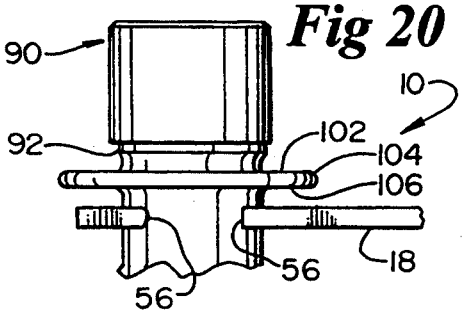
FIG. 20 is a fragmentary side elevational view of a bottle handle showing the spout attachment mechanism attached to the bottle in accordance with the first, third and fourth alternate embodiments of the spout attachment mechanism.
Figure 21:
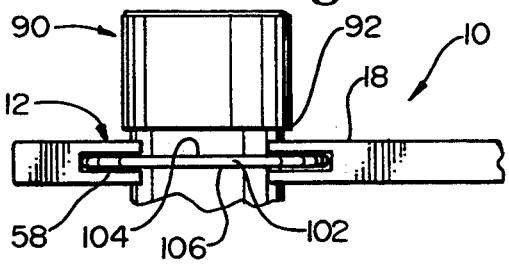
FIG. 21 is a fragmentary side elevational view of a bottle handle showing the fifth alternate embodiment of the spout attachment mechanism attached to the bottle.
Figure 22:
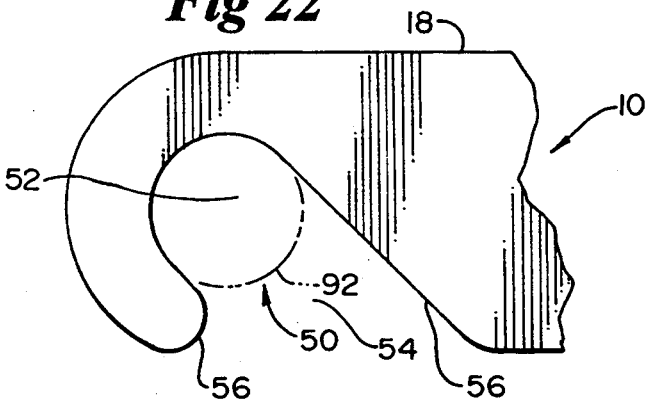
FIG. 22 is a fragmentary top plan view of a bottle handle showing a sixth alternate embodiment of the spout attachment mechanism.

In the first through fifth alternate embodiments of the spout attachment mechanism, shown in FIGS. 16–22, the spout collar 18 includes structure defining a slot 50. The slot 50 includes a generally circular bay 52 and slot channel 54. The slot channel 54 extends from the bay 52 to the outer collar margin 22 and includes one or more spout guides 56. It will be understood that the shape of the bay 52 can be generally ovoid, as shown in FIGS. 16 and 17 or a multi-sided polygon. It will also be understood that the orientation of the slot 50 can vary as shown in FIGS. 16, 17, 18, 19 and 22. Referring to FIG. 17, in a second alternate embodiment of the spout attachment mechanism 12, the spout guides 56 extend outwardly from the spout collar 18 in a direction away from the handle 16 such that the characteristic width of the slot channel 54 at the junction with the bay 52 is less than the characteristic width of the slot channel 54 at the outer collar margin 22. Referring to FIGS. 19 and 21, in a fifth alternate embodiment of the spout attachment mechanism 12, the spout collar 18 further includes structure defining a lip receiving cavity 58 as shown in dashed phantom lines in FIG. 19 and in the side elevational view of FIG. 21.

Referring to FIGS. 5–9, the first through fifth alternate embodiments of the base engagement mechanism 14 are shown. In the first alternate embodiment of the base engagement mechanism 14, shown in FIG. 5, the base engagement mechanism includes an arcuate biasing wall 60 and a hook member 62 extending upward and outward from the biasing wall 60. In the second alternate embodiment of the base engagement 14, shown in FIG. 6, the securing member 32 includes one or more arcuate annular elements 64 projecting upward from the inner surface 34 of the base plate 30. In the third alternate embodiment, shown in FIG. 7, the securing member 32 includes a plurality of dimple elements 66 projecting upward from the inner surface 34 of the base plate 30. In the fourth alternate embodiment, shown in FIG. 8, the securing member 32 is a generally X-shaped projection 68 extending upward from the inner surface 34 of the base plate 30.

Figure 9:
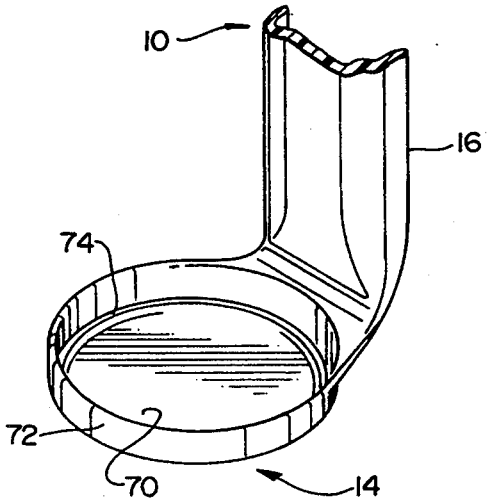
FIG. 9 is a fragmentary perspective view of a bottle handle showing the fifth alternate embodiment of the base engagement mechanism.
Figure 7:
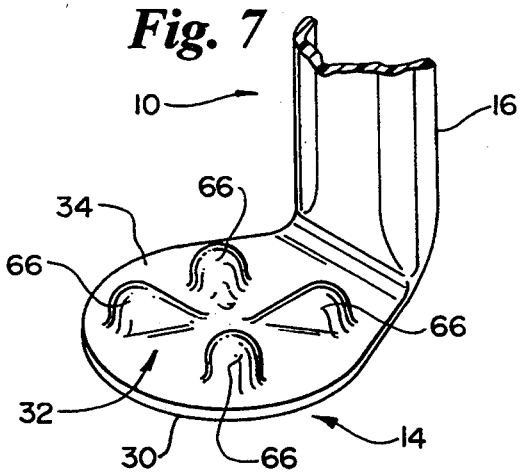
FIG. 7 is a fragmentary perspective view of a bottle handle showing the third alternate embodiment of the base engagement mechanism.
Figure 8:
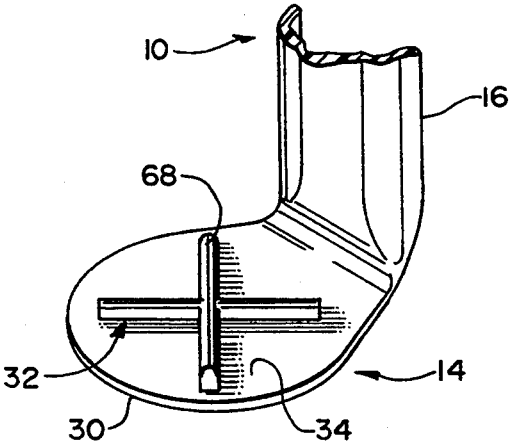
FIG. 8 is a fragmentary perspective view of a bottle handle showing the fourth alternate embodiment of the base engagement mechanism.
Figure 10:
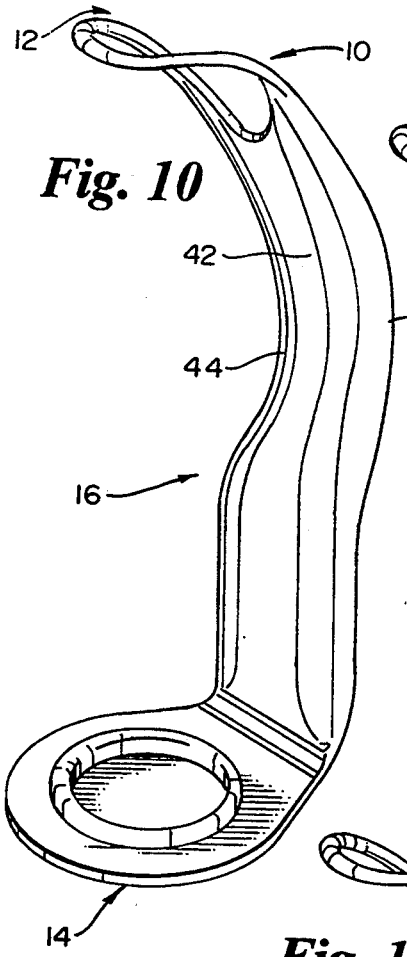
FIG. 10 is a perspective view of a bottle handle showing the first alternate embodiment of the handle member.
Figure 11:
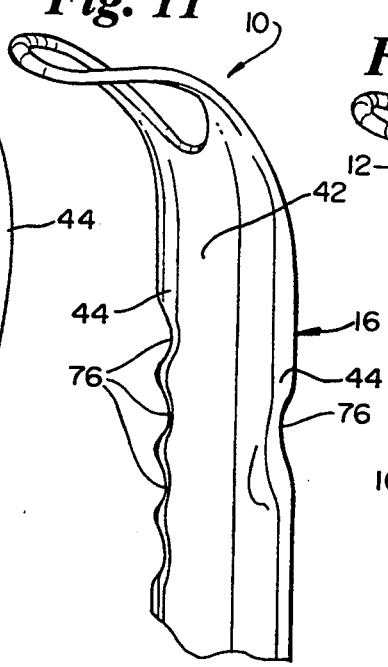
FIG. 11 is a perspective view of a bottle handle showing the second alternate embodiment of the handle member.
Figure 12:
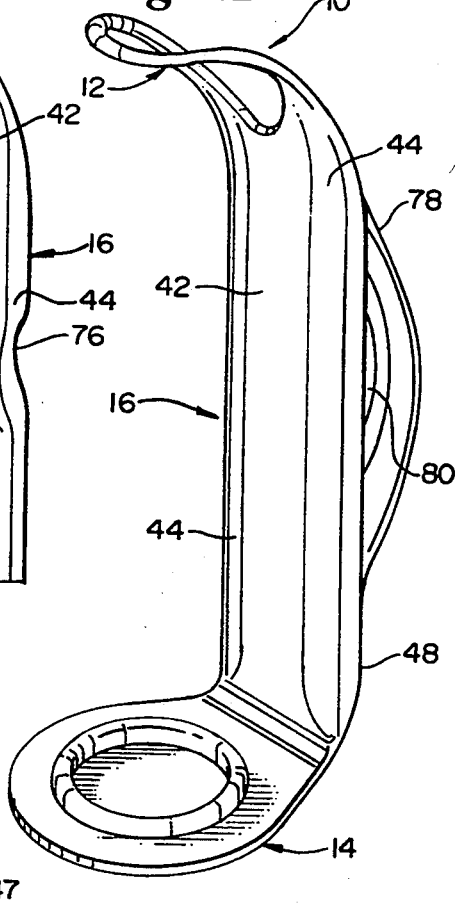
FIG. 12 is a perspective view of a bottle handle showing the third alternate embodiment of the handle member.

Referring to FIG. 9, in the fifth alternate embodiment of the base engagement mechanism 14, the base engagement means 14 includes a generally circular disc 70 and a perimeter wall 72. The disc 70 carries a characteristic diameter and presents a perimeter edge 74. The perimeter wall 72 extends generally vertically upward from the perimeter edge 74.

Referring to FIGS. 10–14, the first through fifth embodiments of the handle 16 are shown. In the first alternate embodiment of the handle 16, shown in FIG. 10, the spine 42 and finger grips 44 extend outwardly as well as upwardly. In the second alternate embodiment of the handle 16, shown in FIG. 11, the finger grips 44 include structure defining a plurality of finger indentations 76. In the third alternate embodiment, shown in FIG. 12, the handle 16 includes a handle extension member 78 extending outwardly from the handle channel 48 such that the structure of the handle extension member 78 and the handle channel 48 define a hand receiving opening 80.

Figure 13:
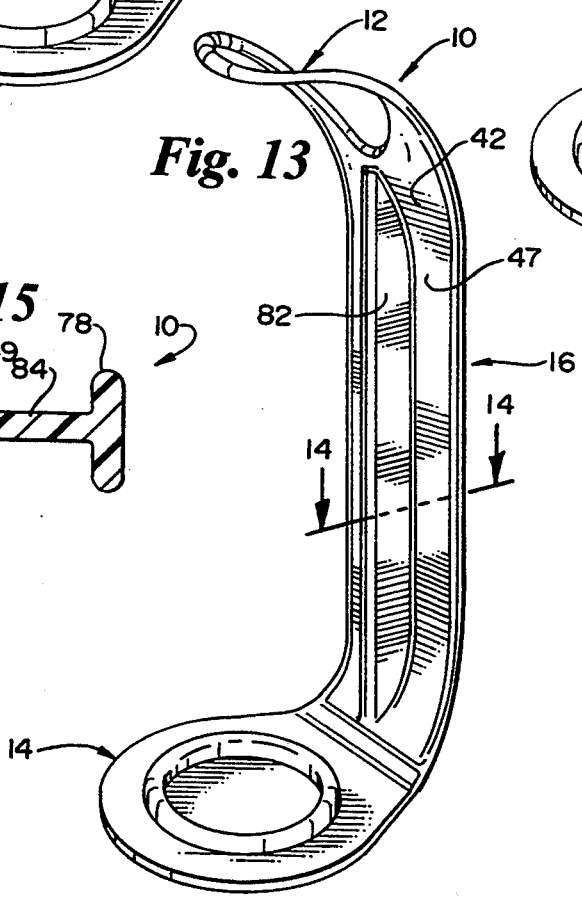
FIG. 13 is a perspective view of a bottle handle showing the fourth alternate embodiment of the handle member.
Figure 15:
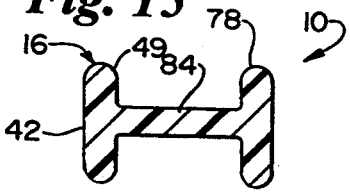
FIG. 15 is a sectional view of the fifth alternate embodiment of the handle member similar to that of FIG. 14.
Figure 14:
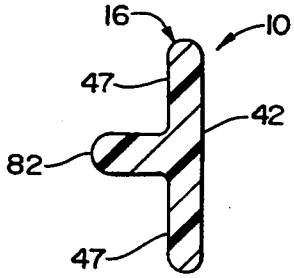
FIG. 14 is a sectional view taken along line 14—14 of FIG. 13.
Figure 18:
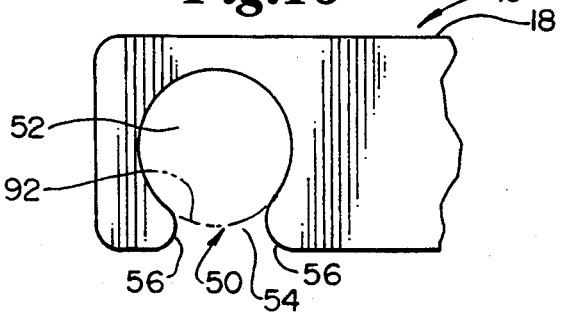
FIG. 18 is a fragmentary top plan view of a bottle handle showing a third alternate embodiment of the spout attachment mechanism.

In the fourth alternate embodiment, shown in FIG. 13, the handle 16 includes a strengthening member 82 extending outward from the inner face 47 of the spine 42 and extending from the spout attachment mechanism 12 to the base engagement mechanism 14. A cross section of the fourth alternate embodiment forms a generally T-shape as shown in FIG. 14. In a fifth alternate embodiment of the handle 16, the handle 16 includes the handle extension member 78 and a handle support member 84 coupled to the handle extension member 78 and outer face 49 of the spine 42. The handle support member 84 extends between the handle extension member 78 and the outer face 49 at a generally perpendicular angle such that a cross section of the handle 16 forms a generally I-shape as shown in FIG. 15.

Referring to FIG. 3, a bottle 90 broadly includes a spout 92, a body 94 and a base 96. The body 94 carries a first end 98 and a second end 100. The spout 92 is a generally circular tube extending upward from the first end 98 of the body 94 and includes a generally horizontal lip 102 extending outwardly from the spout 92. The lip 102 carries an upper lip surface 104 and a lower lip surface 106. The base 96 is integral to the body 94 at the second end 100.

Figure 4:
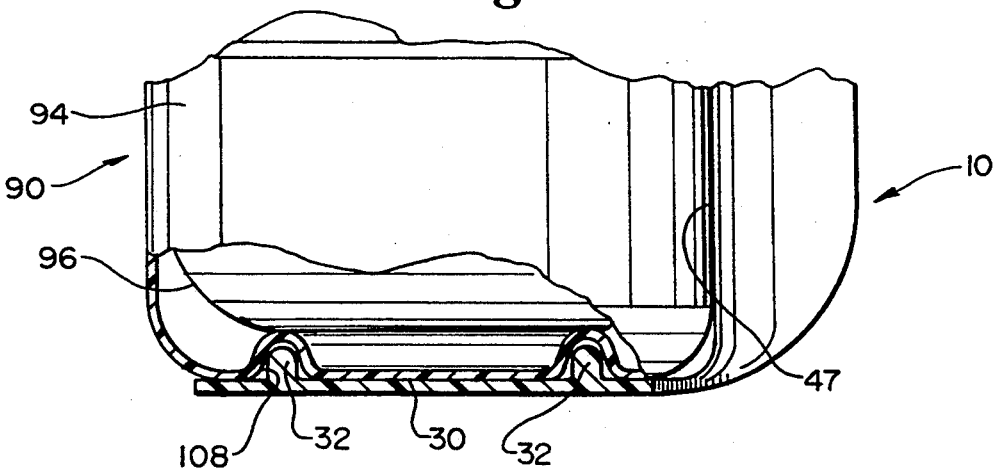
FIG. 4 is fragmentary cut away side view of the base of a bottle with a bottle handle in accordance with the present invention in place on the bottle.
Figure 5:
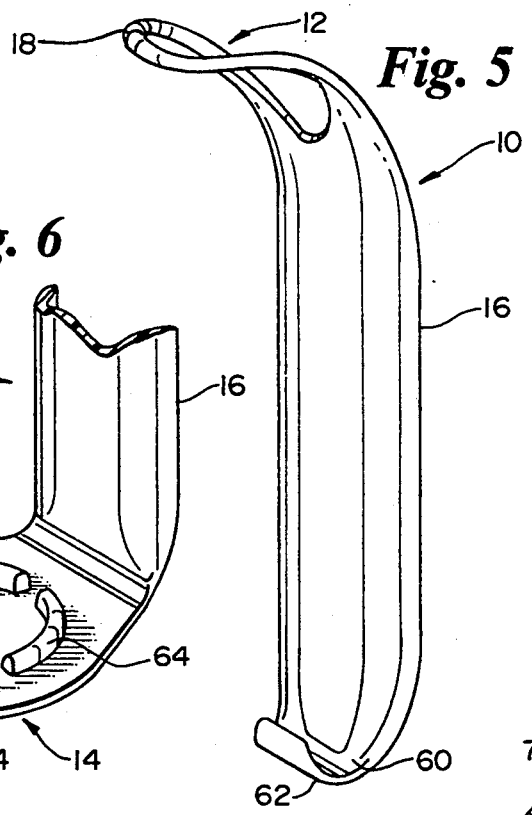
FIG. 5 is a perspective view of a bottle handle showing the first alternate embodiment of the base engagement mechanism.
Figure 6:
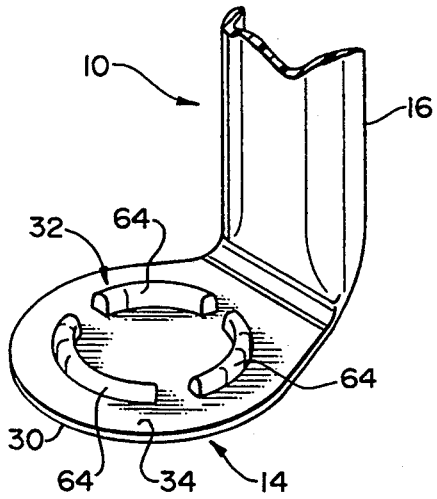
FIG. 6 is a fragmentary perspective view of a bottle handle showing the second alternate embodiment of the base engagement mechanism.

In operation, in the preferred embodiment, the bottle handle 10 is installed on a bottle 90 by receiving the spout 92 within the collar opening 26 in a loose fit as shown in FIG. 3. The base engagement mechanism 14 is placed against the bottle base 96 and the securing member 32 is received in the base recesses 108 in a close fit as shown in FIG. 4. Upon receipt of the securing member 32 in the base recesses 108, the inner face 47 of the handle spine 42 abuts the bottle body 94.

To use the bottle handle 10, an operator grips the finger grips 44 of the handle 16 and lifts, pulling the handle 16 slightly away from the bottle body 94 and biasing the spout collar 18 and base engagement mechanism 14 against the bottle 90 to support the bottle 90. This structure directs force of the operator's efforts unevenly to the first end 98 and second end 100 of the bottle body 94 using the distribution of force as a lever to move the ends 98, 100 of the bottle.

In the preferred embodiment, the spout collar 18 also engages the lower lip surface 106 of the spout 92. By supporting the bottle 90 by the spout 92 and base 96, the bottle 90 is easily manipulated by an adult or by the two hands of a child. Alternate embodiments of the handle 16 provide for convenient operator gripping surfaces and the hand receiving opening 80 encourages an operator to use the strength of their palms as well as their fingers to lift the bottle.

It will be understood that the collar opening 26 is of sufficient size to accommodate spouts 92 of varying characteristic diameters. In alternate embodiments of the spout attachment mechanism 12, it will be understood that the bay 52 and slot channel 54 also are of sufficient size to accommodate spouts 92 of varying diameters. In operation, the slot guides 56 urge the bottle spout 92 into the bay 52 to engage the spout, for example, as shown in FIG. 20. Referring to FIG. 21, in operation, the fifth alternate embodiment of the spout attachment mechanism 12, the lip 102 is received into the lip receiving cavity 58 in a snug fit.

It will be understood that, in the preferred, first, second, third and fourth embodiments of the base engagement mechanism 14, the securing member 32 generally conforms to the base recesses 108 in a close fit. In the fifth alternate embodiment of the base engagement mechanism 14, it will be understood that the disc 70 is of a sufficient size to accommodate the bottle base 96 regardless of the presence of any base recesses 108 in the bottle 90.

It will be understood that the characteristic height of the handle 16 can be varied to accommodate bottles 90 of varying characteristic heights.

Numerous characteristics and advantages of the invention have been set forth in the foregoing description. It will be understood, of course, that this disclosure is, in many respects, only illustrative. Changes can be made in details, particularly in the matters of shape, size and arrangement of parts without exceeding the scope of the invention. The invention scope is defined by the language by which the appendant claims are expressed.

We claim:

1. An apparatus for releasable, lifting attachment to a bottle, the bottle including a spout, a body presenting a bottle longitudinal axis and a base presenting a bottle bottom surface oriented generally orthogonal to said bottle longitudinal axis, the body presenting a first end and an opposed second end, the spout extending upward from the body first end and the base oriented at said body second end, comprising:

a spout collar adapted for detachable engagement of said bottle spout;

a base engagement portion adapted for operable abutable supporting engagement of the bottle base, said base engagement portion including a base plate presenting a base plate margin and a plurality of rounded half conical dimple elements projecting upward from said base plate toward said spout collar, said dimple elements spaced radially inwardly from said bottle base margin; and a flexible, handle member integral with and extending between the spout collar and the base engagement portion, said handle member including a hand graspable portion oriented generally parallel to said bottle longitudinal axis and a self-biasing portion oriented generally transversely to said bottle longitudinal axis and said bottle bottom surface whereby said spout collar and said base engagement portion are biased towards each other and said boss is urged into operable, abutable engagement with said bottle bottom surface by the weight of said bottle when said apparatus is attached to said bottle and said bottle is lifted by grasping said hand graspable portion of said handle member.

2. The apparatus of claim 1 wherein the spout collar includes structure defining a generally ovoid opening of sufficient size to accept the bottle spout.

3. The apparatus of claim 1 wherein the spout collar includes structure defining a slot and presents an outer margin, the slot including an arcuate bay and a channel extending from the bay to the outer margin of the spout collar, the bay presenting a characteristic width of sufficient size to snugly engage the bottle spout, the channel including opposed spout guides for directing the bottle spout into the bay when the apparatus is installed on the bottle, the spout guides flaring outward from the bay such that the characteristic width of the channel at the junction with the bay is less than the characteristic width of the channel at the junction with the spout collar outer margin.

4. The apparatus of claim 1 wherein the base engagement portion includes a base plate extending generally horizontally and of sufficient size to extend along the bottle base.

5. The apparatus of claim 1 wherein the handle member extends outward from the bottle body whereby the handle member and the bottle body define a hand receiving opening for a user to place their hand in when the apparatus is in use.

6. The apparatus of claim 1 wherein the handle member includes a handle extension member and a handle spine member such that the handle extension member and handle spine member define a hand receiving opening for a user to place their hand when the apparatus is in use.

7. The apparatus of claim 6 wherein the handle member further includes a handle support member coupled to the handle extension member and handle spine member and extending between the handle extension member and handle spine member to strengthen the handle means and minimize any movement of the handle member when the apparatus is in use.

8. The apparatus of claim 1 wherein the handle member includes a handle spine member and a strengthening member attached to the handle spine member at a generally perpendicular angle, the strengthening member abuttably engaging the bottle body when the apparatus is in use.

9. The apparatus of claim 1 formed of a synthetic resin in a unitary piece.

10. An apparatus for releasable, lifting attachment to a bottle, the bottle including a spout, a body presenting a bottle longitudinal axis and a base presenting a bottle bottom surface oriented generally orthogonal to said bottle longitudinal axis,the body presenting a first end and an opposed second end, the spout extending upward from the body first end and the base oriented at said body second end, comprising:

a generally ovoid spout collar adapted for detachable engagement of said bottle spout;

a base engagement portion adapted for operable abutable supporting engagement of the bottle base, said base engagement portion including a base plate presenting a base plate margin and a plurality of rounded, half-conical dimple elements projecting upward from said base plate toward said spout collar, said dimple elements spaced radially inwardly from said bottle base margin; and a flexible, handle member integral with and extending between the spout collar and the base engagement portion, said handle member including a hand graspable portion oriented generally parallel to said bottle longitudinal axis and a self-biasing portion oriented generally transversely to said bottle longitudinal axis and said bottle bottom surface, said self-biasing portion including a strengthening member extending generally perpendicularly from said self-biasing portion to said bottle whereby said spout collar and said base engagement portion are biased towards each other by the weight of said bottle when said apparatus is attached to said bottle and said bottle is lifted by grasping said hand graspable portion of said handle member.

11. The apparatus of claim 10 formed of a synthetic resin in a unitary piece.

12. An apparatus for releasable, lifting attachment to a bottle, the bottle including a spout, a body presenting a bottle longitudinal axis and a base presenting a bottle bottom surface oriented generally orthogonal to said bottle longitudinal axis,the body presenting a first end and an opposed second end, the spout extending upward from the body first end and the base oriented at said body second end, comprising:

a spout collar adapted for detachable engagement of said bottle spout;

a base engagement portion adapted for operable abutable supporting engagement of the bottle base, said base engagement portion including a base plate presenting a base plate margin and at least one generally x-shaped bottle engaging boss projecting upward from said base plate toward said spout collar, said bottle engaging boss spaced radially inwardly from said bottle base margin; and a flexible, handle member integral with and extending between the spout collar and the base engagement portion, said handle member including a hand graspable portion oriented generally parallel to said bottle longitudinal axis and a self-biasing portion oriented generally transversely to said bottle longitudinal axis and said bottle bottom surface whereby said spout collar and said base engagement portion are biased towards each other and said boss is urged into operable, abutable engagement with said bottle bottom surface by the weight of said bottle when said apparatus is attached to said bottle and said bottle is lifted by grasping said hand graspable portion of said handle member.

* * * * *